US006733110B1

(12) United States Patent
Pinkernell et al.

(10) Patent No.: US 6,733,110 B1
(45) Date of Patent: May 11, 2004

(54) PRINTING MECHANISM

(75) Inventors: David W. Pinkernell, Washougal, WA (US); Steve O. Rasmussen, Vancouver, WA (US); Vance M. Stephens, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/384,960

(22) Filed: Mar. 10, 2003

(51) Int. Cl.[7] ..... B41J 2/15; B41J 2/145; B41J 2/385; G03G 9/08

(52) U.S. Cl. ..... 347/40; 347/155

(58) Field of Search ..... 347/104, 101, 347/127, 139, 154, 155, 153, 112, 123, 120; 400/578; 226/10; 399/361; 346/134

(56) References Cited

U.S. PATENT DOCUMENTS

| | | | |
|---|---|---|---|
| 5,506,670 | A | 4/1996 | Hatano |
| 5,629,762 | A | 5/1997 | Mahoney et al. |
| 5,725,211 | A | 3/1998 | Blanchard et al. |
| 5,826,154 | A | 10/1998 | Yamashita et al. |
| 5,923,923 | A | 7/1999 | Kobayashi et al. |
| 6,175,715 | B1 | 1/2001 | Hirao et al. |

*Primary Examiner*—Raquel Yvette Gordon

(57) ABSTRACT

A printing mechanism comprises a print engine that prints an image on a first side of a photographic print media, a laminator that laminates the first side of said photographic print media having said image printed thereon, and a duplexer that returns said photographic print media to said print engine for printing on a second side of said photographic print media.

22 Claims, 1 Drawing Sheet

PRINTING MECHANISM

BACKGROUND

Millions of people collect their photo memories in photo albums having two sided photo album pages. The photographic film initially may be taken to a photo store for developing. After picking up the developed film, arrangement of the photos on the album pages may require cutting, arranging and pasting or otherwise adhering the photos to the two-sided album pages. This process may be so labor intensive that many people simply collect their photographs in a shoebox with the best of intentions of creating a photo album, but do not find the time to create the finished album.

In the last few years, digital photographs have become quite common. These photographs may be developed on readily available printers, such as inkjet printers, instead of requiring development of a roll of film at a photo-developing store. However, these digital photographs may still need to be cut, arranged and adhered to the two sides of a double-sided album page. These inkjet developed photographs may be susceptible to water and other types of damage so that in addition to the labor of cutting, arranging and adhering of the photos to the album page, a protective covering may be required to be adhered to the page to protect the photographs.

SUMMARY OF THE INVENTION

A printing mechanism comprises a print engine that prints an image on a first side of a photographic print media, a laminator that laminates the first side of said photographic print media having said image printed thereon, and a duplexer that returns said photographic print media to said print engine for printing on a second side of said photographic print media.

DETAILED DESCRIPTION OF THE DRAWING

Figure 1:
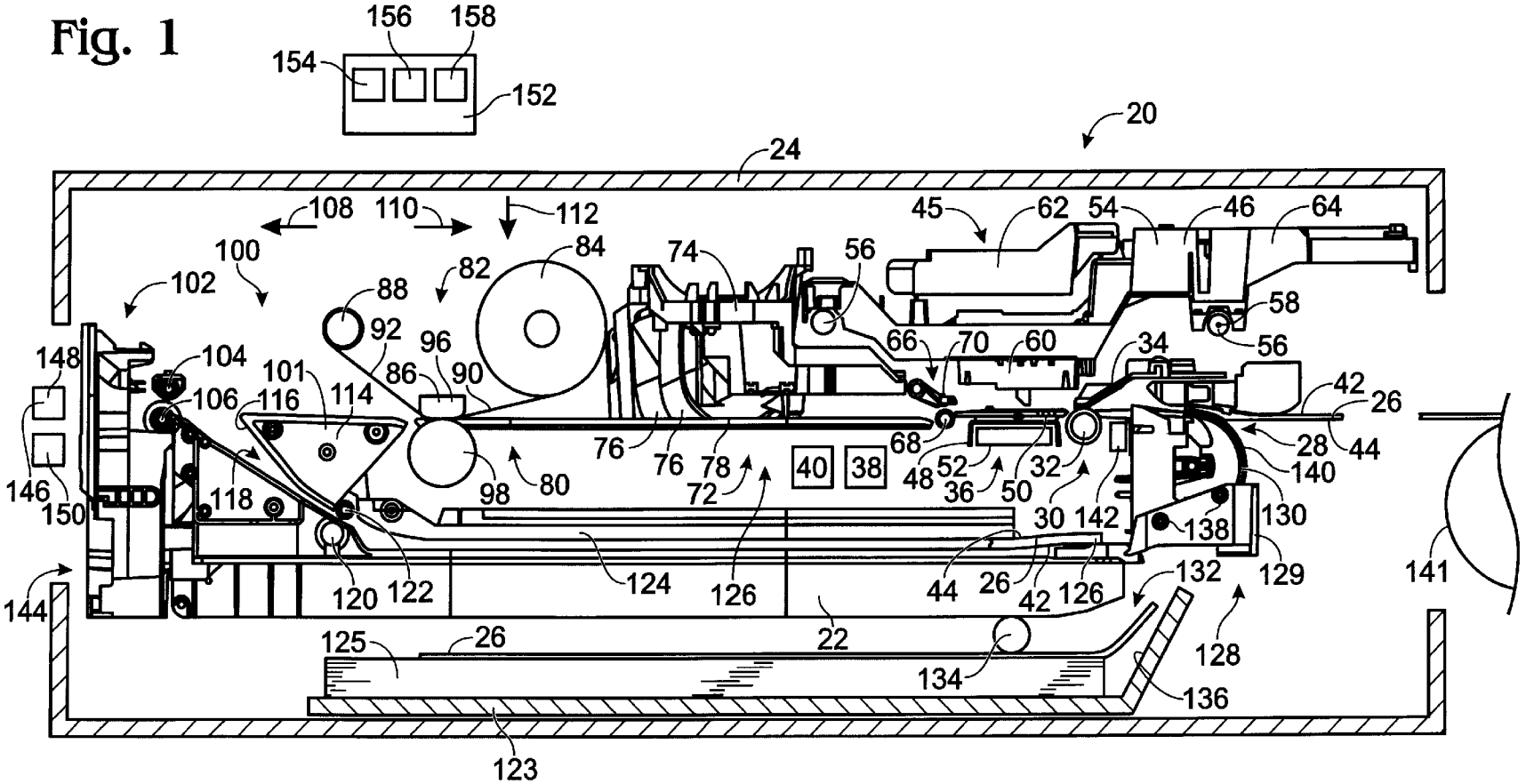
FIG. 1 is a side cross sectional view of one form of a printing mechanism, here shown as a printer having a print engine, a dryer, a laminator and a duplexer.

FIG. 1 illustrates one embodiment of a printing mechanism, here shown as a printer 20, which may be used for the printing of business reports, correspondence, desktop publishing, and the like including photographic images, in an industrial, office, home or other environment. A variety of printing mechanisms is commercially available, such as inkjet printers and laser printers, for example. Some of the printing mechanisms that may use embodiments of the present invention include plotters, portable printing units, copiers, cameras, video printers, and facsimile machines, to name a few. For convenience, the concepts of the printing mechanism are illustrated in the environment of an inkjet printer 20.

While it is apparent that the printer components may vary from model to model, the inkjet printer 20 includes a chassis 22 surrounded by a housing, also called a body or a casing enclosure 24, which may be manufactured of any suitable polymeric material . Chassis 22 may be manufactured of steel or other suitable frame material. A sheet 26 of print media is fed into an input feed zone 28. The print media sheet may be any type of suitable double-sided photographic material, such as double-sided photographic paper, card-stock, transparencies, mylar®, and the like, but for convenience, the illustrated embodiment is described using double-sided photograph printing paper as the print medium. By "double" or "dual-sided photographic print media," Applicants mean that the print media is capable of having a photographic image printed on both sides of the print media. Sheet 26 may be fed to input feed zone 28 in a variety of methods, such as from a paper roll (a partial roll is shown), by hand feeding of a single sheet (as shown), from a paper tray, or from a duplexer contained within the printer (described in more detail below).

Once the sheet is input into input feed zone 28, the sheet may be captured by a drive means 30, such as a drive roller 32 and a pinch arm 34, which drive the sheet into a print zone 36. The drive means may be powered by a motor 38 controlled by a printer controller, illustrated schematically as a microprocessor 40, that receives instructions from a host device, typically a computer, such as a personal computer (not shown). Indeed, many of the printer controller functions may be performed by a host computer, by the electronics on board the printer, or by interactions therebetween. As used herein, the term "printer controller 40" encompasses these functions, whether performed by a host computer, the printer, an intermediary device therebetween, or by a combined interaction of such elements. The printer controller 40 may also operate in response to user inputs provided through a key pad (not shown) located on the exterior of the housing 24. A monitor coupled to a computer host may be used to display visual information to an operator, such as the printer status or a particular program being run on the host computer. Pinch arm 34 may apply pressure to a printing surface 42 of the sheet so as to force a lower surface 44 of the sheet against rotating drive roller 32. Drive roller 32 may be a high grip, accurately metered roller so that the speed of the sheet through print zone 36 is driven and controlled by controller 40.

Print zone 36 may comprise a print engine 45, also called a printing means, that includes a carriage 46 positioned above printing surface 42 and a platen 48 positioned below lower surface 44 of the sheet. Platen 48 may comprise a flat upper surface 50 having apertures therein, and a vacuum system 52 that applies a vacuum pressure to the area above upper surface 50, through the platen apertures, so as to hold lower surface 44 of the sheet against the platen for printing on the sheet. Other means may be used to hold the sheet in a generally flat orientation during printing, such as guide rods (not shown) that force the sheet against the platen.

Carriage 46 may comprise a carriage housing 54 that in the embodiment shown is supported on two carriage rods 56 that define a scan axis 58 (shown extending into the page in this figure). The carriage may move back and forth across sheet 26 along scan axis 58 during printing on the sheet. Carriage housing 54 may include one or more print heads. In the embodiment shown, carriage housing 54 supports six print heads, wherein only one print head 60 can be seen in this view, and the remaining five print heads are positioned in a row behind the print head 60. The six print heads may each include a colored ink such as black, cyan, magenta, yellow, light cyan, and light magenta. Of course, other colors, and any dye or ink type may be utilized in the printer mechanism. The print heads may be held in place within the carriage housing by a latch mechanism 62, which may be removed or loosened for changing or otherwise servicing the print heads. The carriage housing may further comprise an electronics region 64 for housing the electronics (not shown) for operating the individual print heads.

Positioned on an opposite side of print zone 36 from drive means 30 is a second drive means 66. Drive means 66 may comprise an output pinch roller system including a roller 68 and a pinch arm 70. Drive means 66 may function to tension the sheet 26 of print media in print zone 36 and may further function to drive the sheet of print media out of the print zone and into a drying zone 72.

Drying zone 72 may comprise a dryer 74 positioned above printing surface 42 of sheet 26. In the embodiment shown, dryer 74 is a convective dryer that blows hot air through air flow directors 76 onto and across freshly printed surface 42 of the sheet. The hot air that is blown across the sheet accelerates the evaporation of water from water-based ink that may be used to print an image on sheet 26. Sheet 26 may be supported in drying zone 72 on a support surface 78 that supports lower surface 44 of the sheet as hot air is blown on upper, printed surface 42 of the sheet. After drying of the ink on sheet 26, the sheet is fed by drive means 30 and 66 through a lamination zone 80.

Lamination zone 80 may comprise a laminator 82, also called a coating means or a sealing device, including a supply of lamination material 84, such as a roll of transparent lamination film, an adhesion device 86, and a take-up device 88, such as a take-up roller. In the embodiment shown, roll of film 84 comprises a roll of transparent lamination film 90 mounted on a non-adhesive backing 92, such as wax paper. Backing 92 may be collected by take-up roller 88 by rolling the paper on the roller after the lamination film 90 has been adhered to the sheet of print media. Accordingly, roller 88 may be powered by a motor, such as motor 38, and controller 40 to move roll of film 84 through adhesion device 86 at the same rate that sheet 26 is moved through the lamination zone. Adhesion device 86 may comprise a pressure bar 96 and a pressure roller 98 wherein sheet 26 and film 84 are both moved therebetween. In the embodiment shown, pressure bar 96 further comprises a heater so that sheet 26 and film 84 are both heated as they are pulled between the pressure bar and the pressure roller. The combination of pressure and heat supplied by pressure bar 96 acts to secure lamination coating 90 to freshly printed and dried surface 42 of the sheet so as to provide a robust coating for the printed image, thereby enabling the photographic print media to travel through a duplexer after the media has already been printed upon. Pressure roller 98 may be powered by a motor, such as motor 38, and controller 40 such that roller 98 works in conjunction with rollers 32 and 68 to move sheet 26 through the printer. Due to the position of dryer 74 upstream of laminator 82, the print media is generally dried prior to lamination, thereby reducing moisture that may become trapped between the print media and the lamination coating placed thereon.

After sheet 26 is moved through lamination zone 80, the sheet is moved into a duplexer zone 100, and into a media output zone 102. If the sheet has already been printed on both sides, or if printing is only desired on a single side of the sheet, the sheet is fed completely through output zone 102 and out of the printer by output rollers 104 and 106. Rollers 104 and 106 are each powered by a motor, such as motor 38, and by controller 40 such that the rollers move the sheet through the lamination zone and out of the printer at the desired throughput speed.

If sheet 26 is to be fed through the printer a second time, so that printing may occur on lower surface 44 of the sheet, then the sheet is returned to duplexer zone 100 after a trailing region of the sheet is captured by rollers 104 and 106. Controller 40 may function to sense the position of the trailing edge of the sheet, and to control the rotation of rollers 104 and 106 so that the rollers move sheet 26 in a forward direction 108 until the trailing region of the sheet clears duplexer zone 100. Once the trailing region of the sheet has cleared the duplexer zone, the controller may cause rollers 104 and 106 to reverse their rotational direction so that the trailing region of the sheet is moved in rearward direction 110 toward duplexer region 100. Upper roller 104 may be slightly biased in rearward direction 110, and/or in a downward direction 112, with respect to lower roller 106 so that as the trailing region of sheet 26 is fed in rearward direction 110 into duplexer zone 100, the trailing edge of the sheet is biased downwardly in downward direction 112.

Duplexer zone 100 may comprise a duplexer 101, also called a return means, including a duplexer guide device 114 having a downwardly sloping surface 116. Sloping surface 116 may define a duplexer return path 118 that extends downwardly and below support surface 78 of dryer 74. As the trailing or rearward region of the sheet is moved in rearward direction 110 and in downward direction 112 by the slightly reward position of upper roller 104 with respect to lower roller 106, the sheet is forced downwardly by downwardly sloping surface 116 and into return path 118. Rollers 104 and 106 may continue to move the sheet into return path 118 so that the entire sheet 26 is moved into the duplexer return path 118. Duplexer rollers 120 and 122 may capture the sheet in a lower region of the return path 118 and continue movement the sheet through the return path. In the embodiment shown, return path 118 extends between a paper tray 123 and a duplexer guide 124, and below a component region 126 of the printer. Paper tray 123 may be adapted to accommodate a stack 125 of photo sized album media, such as 8×10, 8×11, 11×14 and 13×14 inch sheets, as well as any other sheet size as is desired. In the embodiment shown, the printing mechanism is adapted to receive print media having a width of as much as 13 inches. Component region 126 may house a variety of printer components such as the vacuum system for platen 48, electronics components and/or gearing mechanisms and motors for the various components, such as motor 38 and controller 40. Guide 124 may retain the sheet in a generally flat orientation during movement through return path 118. After movement through the return path, the rearward region 126 of sheet 26, which has now become the leading region of the sheet due to the change in direction of the sheet in duplexer zone 100, is moved into a converger zone 128.

Converger zone 128 may comprise a converger 129 including guide device 130 and a pick mechanism 132 that is adapted to pick a sheet from paper tray 123 for feed into input feed zone 28. Pick mechanism 132 may comprise a pick roller 134 that picks a sheet from tray 123 and a separator, such as a sloped separator surface 136. In addition to pick roller 134, each of the rollers, support surfaces, guides, and/or pinch arms of the printer may be referred to collectively or individually as the transport system of the printing mechanism. In the embodiment shown, separator surface 136 separates the picked sheet from a remainder of sheets in tray 123, and guides the picked sheet from tray 123 upwardly into converger zone 128. Guide device 130 may comprise a series of rollers 138 and a curved surface 140 that guide print media from paper tray 123, from a roll of print media (shown partially), from the manual input of print media, or from duplexer return zone 118, into input feed zone 28. In particular, print media fed manually, or from a roll 141, to the printer may be guided into the print zone by an upper surface of curved surface 140 whereas print media from the duplexer and the paper tray may be guided into the print zone by a lower surface of curved surface 140.

The converger zone may further comprise a cutting device, such as a blade 142, that cuts a sheet of print media from a roll of print media as the print media is feed into the converger zone, such that a single sheet is fed through the printer from the roll if desired. Guide device 130 also facilitates manual feed of print media into input feed zone 28, as initially described. Accordingly, converger 129 allows many types of input methods of print media into printer 20.

Printing mechanism 20 may further comprise a binder zone 144 positioned downstream of media output zone 102, the binder zone comprising a binder 146 that includes a hole punch device 148 and a binder clip feed device 150. The binder 146 may operate to collect multiple dual-sided photo sheets printed by the printer, align the sheet edges, punch a desired number and arrangement of holes in an edge region of the aligned sheets, and then place a binder device, such as a plastic spiral binder clip, through the punched holes to produce a binder of double-sided photo album pages. Accordingly, the printing mechanism as shown in the figure is adapted to produce a photo album having double-sided printed photo pages, wherein the pages are bound together, and the photo images are printed directly on the album pages. Use of the printing mechanism, therefore, allows a user to avoid cutting, arranging and pasting or otherwise adhering separate photos to blank album pages of a conventional photo album.

Printing mechanism 20 may further comprise, or may be operatively connected to, an input device 152 (shown schematically), such as a printing kiosk located in a retail setting such as a shopping mall or a personal computer located in an operator's home. Input device 152 may comprise a viewing device 154, such as a screen or monitor, to view a digital image of a photo or an arrangement of digital photos to be printed, and an operator input device 156, such as a keyboard and/or a mouse device, which allows manipulation of the photo image or images viewed on the screen. Input device 152 may further comprise an image manipulation device 158, such as a software program that allows downloading, arranging, cropping, enlarging, shrinking, color enhancing, and other such manipulation of digital images, to create the desired virtual photo album page. Input device 152, therefore, allows the user to arrange one or more digital images on a page, in any desired orientation or size, and then send this information to the print engine to print the page directly on a photo album page. Due to the duplexer capabilities of the printing mechanism which allow a sheet to be returned to the print zone, and due to the lamination capabilities of the printing mechanism which allow a single printed side of a sheet to be protected prior to the sheet being fed through the duplexer return path for printing on an opposite side of the sheet, the user may print a desired image directly on an opposite side of the already printed photo album page. Multiple dual-sided photo sheets may then be collected in the binder, bound together, and output by the printer to the user as a finished photo album having photo images printed directly on both sides of the album pages.

There is described a printing mechanism for printing dual-sided photo sheets, i.e., sheets printed on both the front and the back of the photo media, comprising a print engine, a laminator, and a duplexer. The printing mechanism may further comprise a dryer, a paper tray, a binder and an input terminal for arranging and otherwise editing a virtual or a digital image of the image to be printed. The printing mechanism facilitates the creation of double-sided photo albums with the images printed directly on the album pages, without requiring the user to manually cut, arrange and paste or otherwise adhere separate photos to blank album pages of a conventional photo album.

And finally, the illustrated embodiment of FIG. 1 is shown to illustrate the principles and concepts of the invention as set forth in the claims below, and a variety of modifications and variations may be employed in various implementations while still falling within the scope of the claims below.

We claim:

1. A printing mechanism, comprising:

a print engine that prints an image on a first side of a photographic print media;

a laminator that laminates the first side of said photographic print media having said image printed thereon; and a duplexer that returns said photographic print media to said print engine for printing on a second side of said photographic print media.

2. The printing mechanism of claim 1 further comprising a dryer positioned between said print engine and said laminator.

3. The printing mechanism of claim 2 wherein said dryer comprises a support surface for supporting said photographic print media and a convection dryer that blows hot air through air flow directors onto and across said photographic print media as said print media is supported on said support surface.

4. The printing mechanism of claim 1 further comprising a binder, a converger and a print media tray.

5. The printing mechanism of claim 4 wherein said binder comprises a collection device, a hole punch device and a binder clip feed device, wherein said collection device collects multiple sheets of said photographic print media printed by the print engine and aligns the sheets to create a stack, wherein said hole punch device punches a desired number and arrangement of holes in an edge region of the stack of aligned sheets, and wherein said binder clip feed device places a binder device through said punched holes to produce a photo album.

6. The printing mechanism of claim 4 wherein said converger comprises a guide device and a pick mechanism adapted to pick a sheet from a print media tray, wherein said guide device comprises a roller and a curved surface that guide print media to said print engine from said paper tray, from a roll of print media, from a manual input zone of said printing mechanism, and from said duplexer, and wherein said converger further comprises a cutting device that cuts said print media when said print media is in the form of a roll, such that a single sheet of print media is fed to said print engine.

7. The printing mechanism of claim 1 further comprising an input device adapted for manipulating a virtual image of said image printed by said print engine.

8. The printing mechanism of claim 7 wherein said input device further comprises a monitor that allows an operator to view a virtual image of said image printed on said first side of a photographic print media, a keyboard device and a mouse device that allow manipulation of the virtual image, and a software program that allows downloading, arranging, cropping, enlarging, shrinking, and color enhancing of said virtual image.

9. The printing mechanism of claim 1 further comprising a transport system.

10. The printing mechanism of claim 1 wherein said laminator comprises a roll of transparent lamination film mounted on a backing, a take-up roll for taking up said backing after said lamination film is removed therefrom, and a pressure bar that applies heat and pressure to said lamination film to adhere said film to said photographic print media.

11. The printing mechanism of claim 1 wherein said duplexer comprises a guide device having a downwardly sloping surface that guides said photographic print media into a return path for return to said print engine.

12. The printing mechanism of claim 1 wherein said print engine includes a plurality of inkjet print heads each including a plurality of nozzles for applying ink to said photographic print media.

13. A printing mechanism comprising:

printing means for printing an image on one side of a dual-sided photo media;

coating means for coating said one side of said photo media after said image is printed thereon; and return means for returning said photo media to said printing means for printing on an opposite side of said photo media.

14. The printing mechanism of claim 13 wherein said return means turns said photo media with respect to said printing means so as to expose said opposite side of said photo media to said printing means prior to printing on said opposite side.

15. The printing mechanism of claim 13 further comprising transport means for transporting said photo media through said printing mechanism.

16. The printing mechanism of claim 13 further comprising drying means for drying said photo media, said drying means positioned upstream of said coating means.

17. The printing mechanism of claim 13 further comprising image manipulation means for manipulating a digital image of said image printed on said photo media, and controller means for controlling the printing means, the coating means and the return means.

18. An improved printing mechanism including a print head for printing photographic images on a print media, wherein the improvement comprises:

a sealing device for applying a seal to a first image printed by said print head on said print media; and a duplexer device for returning said print media to said print head for printing a second photographic image on an opposite side of said print media.

19. A printing mechanism comprising:

an input terminal that allows a user to create an image of a photo album page;

a print head that prints said image on a first side of a photo media;

a coater that coats said first side of said photo media after printing of said image thereon; and a transport system that transports said photo media to said print head for printing on a second side of said photo media.

20. A printing mechanism comprising:

an input terminal adapted to download and allow operator manipulation of a plurality of digital photographic images to create a virtual photo album page image;

a print head carriage including a plurality of inkjet print heads adapted for printing said virtual photo album page image on a photographic media;

a convective dryer positioned downstream of said print head carriage, said dryer adapted for blowing hot air over said printed photo album page image so as to dry said image;

a laminator positioned downstream of said convective dryer, said laminator adapted for laminating said printed photo album page image on said photographic media so as to seal said printed photo album page image;

a duplexer positioned downstream of said laminator, said duplexer adapted for returning said printed photographic media to said print head with an unprinted side of said photographic media exposed to said print head for printing of a second photo album page image thereon; and a binder positioned downstream of said duplexer, said binder adapted for binding multiple photographic media together to create a photo album having photo album page images printed directly on both sides of said photographic media.

21. A laminating device, comprising:

a print head adapted for printing an image on one side of a photographic print media;

a laminator that laminates said one side of said photographic print media having said image printed thereon; and a duplexer that returns said photographic print media to said print head for printing on another side of said photographic print media.

22. A media handling device, comprising:

a printing device adapted to print an image on a first side of a photographic media;

a coating device adapted to coat said first side of said photographic media; and a transport device adapted to transport said photographic media to said printing device such that a second side of said photographic media is positioned for printing thereon by said printing device.

* * * * *